United States Patent [19]

Hodgson et al.

[11] 4,078,218

[45] Mar. 7, 1978

[54] MAGNETIC CONTACTOR

[75] Inventors: Alfred W. Hodgson, Orchard Park; James D. Collins, Elma, both of N.Y.

[73] Assignee: Westinghouse Electric Corporation, Pittsburgh, Pa.

[21] Appl. No.: 695,677

[22] Filed: Jun. 14, 1976

Related U.S. Application Data

[63] Continuation-in-part of Ser. No. 657,428, Feb. 14, 1976, abandoned.

[51] Int. Cl.[2] ..... H01H 67/02

[52] U.S. Cl. ..... 335/128; 200/146 R

[58] Field of Search ..... 335/128, 133, 201; 200/146, 147

[56] References Cited

U.S. PATENT DOCUMENTS

| | | | |
|---|---|---|---|
| 2,970,197 | 1/1961 | Frink | 200/147 |
| 3,092,699 | 6/1963 | Latour | 200/147 X |
| 3,210,506 | 10/1965 | Frink | 200/146 |
| 3,238,339 | 3/1966 | Fehling | 200/146 |
| 3,511,950 | 5/1970 | Boyd | 200/147 |
| 3,585,329 | 6/1971 | Walker et al. | 200/146 |
| 3,659,237 | 4/1972 | Wilsdon et al. | 335/128 X |

*Primary Examiner*—George Harris
*Attorney, Agent, or Firm*—L. P. Johns

[57] ABSTRACT

A magnetic contactor characterized by stationary and movable contacts with the stationary contact comprising at least two contact sections including a pivot section for limited movement toward the movable contact. The pivot section is mounted on a pivot edge of a first conductor and is spring biased against the pivot edge and in a position of limited movement. The movable contact is mounted on a support lever which is pivotally mounted to effect limited vertical and horizontal movement of the movable contact with respect to the stationary contact. The electromagnetic means of the contactor comprises an armature for moving the lever, and link means between the lever and the armature and includes a spring biasing structure for effecting overtravel movement of the lever. Finally, a magnetic blowout assembly and an arc chute are provided adjacent to the stationary contact zone for facilitating the interruption of an arc incurred during separation of the contacts.

18 Claims, 5 Drawing Figures

MAGNETIC CONTACTOR

CROSS-REFERENCE TO RELATED APPLICATIONS

This invention is related to those disclosed in the copending applications of Alfred W. Hodgson, Ser. No. 657,427, filed Feb. 12, 1976 now abandoned; and Ser. No. 657,429, filed Feb. 12, 1976 now abandoned; and is a continuation-in-part of application Ser. No. 657,428, filed Feb. 14, 1976 now abandoned.

BACKGROUND OF THE INVENTION

1. Field of the Invention

This invention relates to a magnetic contactor and, more particularly, it pertains to a compact, single pole DC magnetic contactor having increased ratings.

2. Description of the Prior Art

The outlying dimensions of magnetic contactors are primary considerations in their acceptance by industry and their commercial success. This is particularly true of contactors for use in industry such as marine, railroad, mining, offshore drilling, offroad construction, where space is at a premium. In some of these applications, machinery has already been designed around a particular size of contactor. Consequently, new contactors must be directly interchangeable with the prior contactor. Associated with the foregoing is a requirement that cost be minimal and continuous current carrying capacity and interrupting ratings be greater than the original contactor. Accordingly, the requirements of limited space, minimum cost, and increased rating have presented a problem to the manufacturers of magnetic contactors.

SUMMARY OF THE INVENTION

In accordance with this invention it has been found that the foregoing problem may be overcome by providing a magnetic contactor comprising stationary contact means including a plurality of stationary contact sections including fixed contact sections and a pivoted contact section and mounted on a first conductor, a movable contact mounted on a movable conductor which is movable between open and closed contact positions, the fixed contact sections having substantially aligned contact surfaces facing the movable contact, the first conductor having a pviot edge on which the pivot section is mounted, spring means for holding the pivot section against the pivot edge and for biasing the contact surface of the pivot section out of alignment with those of the stationary contact sections on the side of the movable contact, electromagnetic means for moving the movable conductor to the closed position, operative means for moving the movable conductor to the open position which the electromagnetic means is deenergized, the electromagnetic means comprising an armature for moving the movable conductor, link means between the movable conductor and the armature and comprising a suspension rod and spring structure for limited moving contact movement and for effecting overtravel movement of the movable conductor, kickout spring means connected to the assembly of the armature and the movable conductor for facilitating separation of the contacts when the electromagnetic means is deenergized, an arc chute adjacent to the stationary and movable contacts, magnetic blowout means adjacent to the stationary and movable contacts for moving an arc from the contacts into the arc chute when the contacts are separated, the magnetic blowout means comprising a looped section of the first conductor, a magnetic core within the loop, ferromagnetic flux-carrying pole pieces abutting against the ends of the magnetic core and extending radially beyond the blowout coil and along opposite sides of the arc chute, and an auxiliary blowout coil connected in series with the looped portion of the first conductor and around the magnetic core to generate an increased magnetic field within the arc chute and thereby facilitate removal of arc from the contacts.

The advantage of the device of this invention is that it provides a compact, low cost, single pole, DC magnetic contactor having an increase in continuous current rating and a corresponding increase in interrupting capacity without an increase in its size or manufacturing cost over contactors of prior construction.

DESCRIPTION OF THE PREFERRED EMBODIMENT

Figure 1:
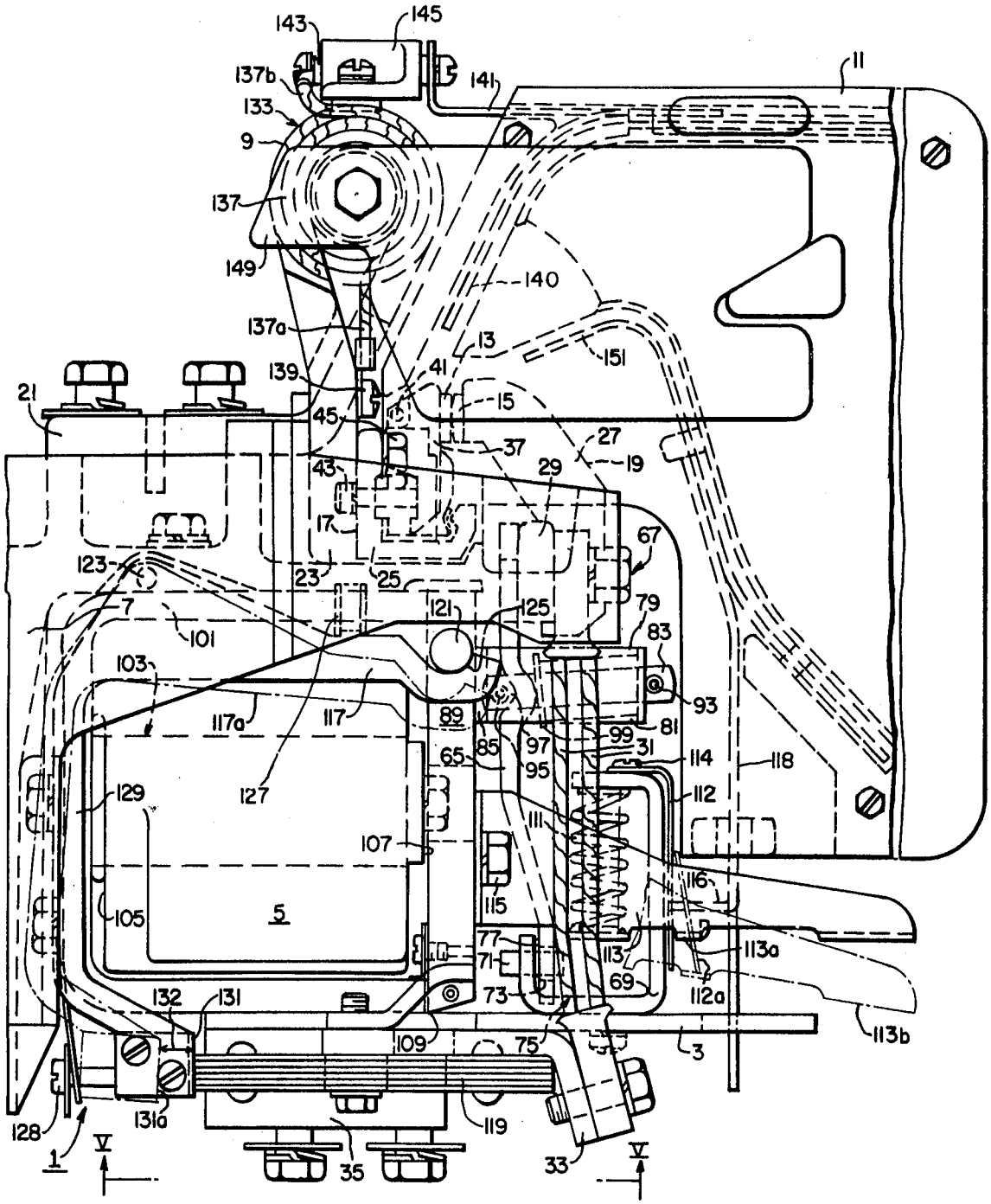
FIG. 1 is a left side view of the contactor of this invention.

In FIG. 1 a contactor is generally indicated at 1 and it comprises a base plate 3, electromagnetic means or electromagnet 5, an electrically insulating housing 7, arc blowout unit 9, and an arc chute 11. The contactor 1 also comprises a stationary contact 13 and a movable contact 15 which are mounted on conductor structures 25 and 19, respectively.

The contactor 1 of this invention is generally described in U.S. Pat. No. 3,511,950 for which reason the description of the contactor 1 is limited herein to the basic structure, operation, and new and different structures. Suffice it to say, an electrical circuit through the contactor 1 includes a line terminal 21, the blowout unit 9, contact mounting bracket 25, contacts 13, 15, contact mounting arm 27, contact shunt connector 29, shunt 31, shunt connector 33, and load terminal 35. The blowout unit 9 comprises a coil 133 (FIG. 3) extending from the terminal 21 to the bracket 25.

The stationary contact 13 comprises a plurality of, such as two, fixed contact sections 37, 39 (FIG. 4) and a pivoted contact section 41, which is disposed between the fixed sections. The fixed contact sections 37, 39 are secured by similar bolts 43 through the contact mounting bracket 25 which is secured by spaced bolts 45 to the lower end of a blowout coil 133. Thus, there is optimum electrical contact between the fixed contact sections 37, 39 and the bracket 25. Moreover, the stationary contact subassembly including the bracket 25 and the contact sections 37, 39, 41 is replaceable without removing the line connection to the line terminal 21.

Figure 3:
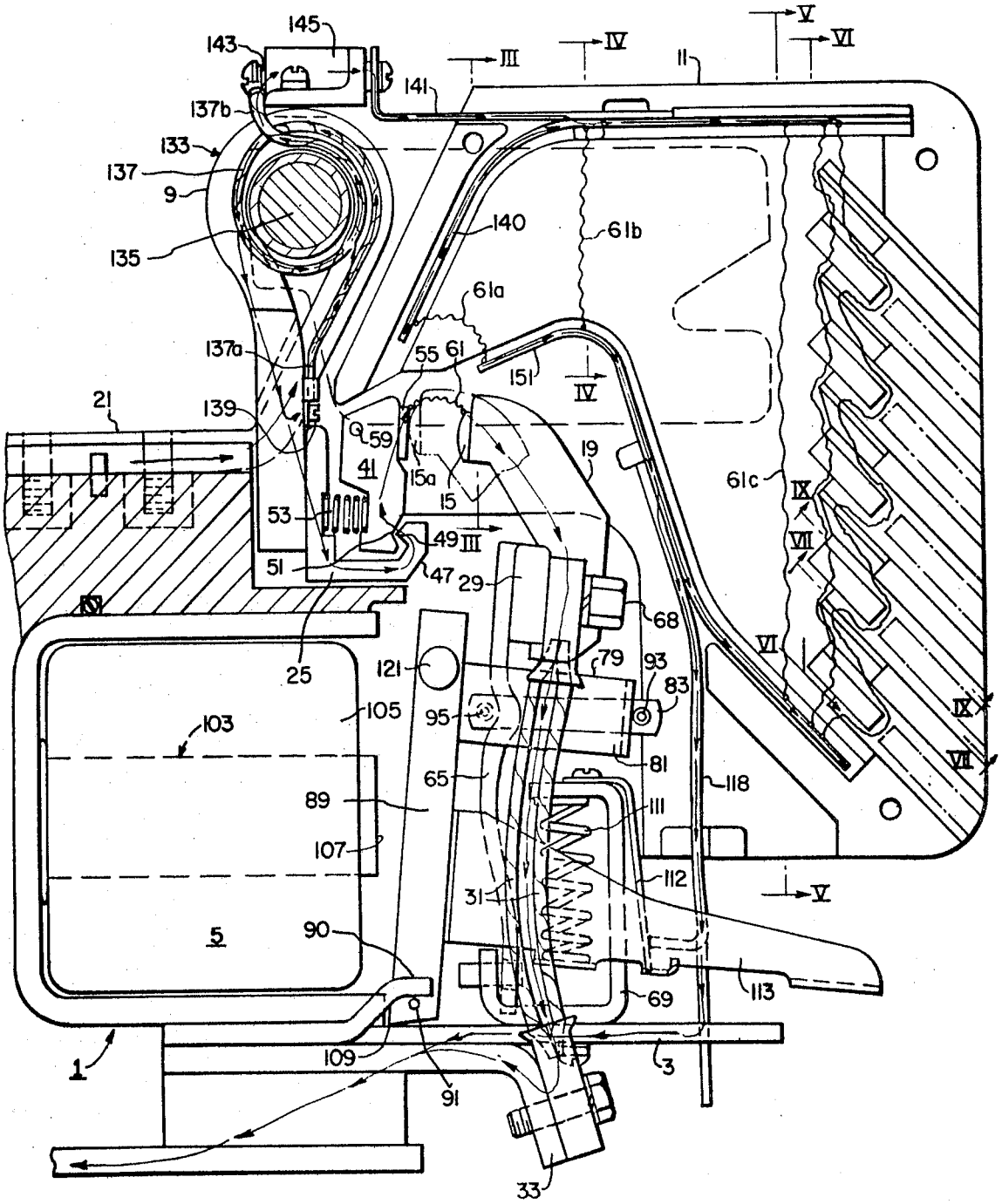
FIG. 3 is a sectional view.
Figure 4:
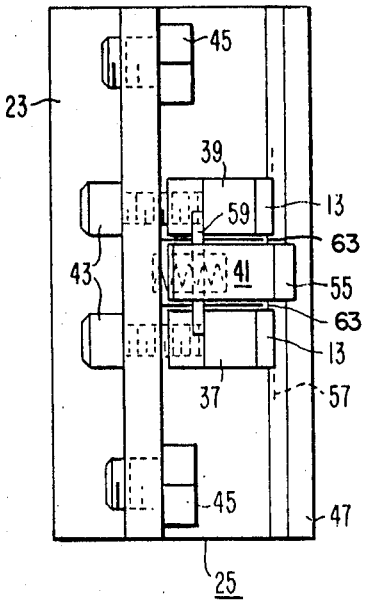
FIG. 4 is a fragmentary plan view of the stationary contact.

As shown more particularly in FIG. 3, the pivot contact section 41 is pivotally mounted on the bracket 25 which is an extruded member having a reversed-J configuration which includes an upturned portion 47 comprising a pivot point of knife edge 49. The pivot section 41 includes a corresponding in-turned groove 51 having a V-shaped cross section in which the knife edge 49 is seated. A coil spring 53 is disposed between the bracket 25 and the pivot section 41 on the side thereof opposite the pivot location. In addition, the spring 53 biases the pivot section 41 clockwise about the pivot point of knife edge 49. As a result, a contact 55 of the pivot section 41 is normally disposed beyond the frontal contact surfaces of the contacts 13 as defined by a line 57 (FIG. 4). The pivot section 41 also includes a limit pin 59 which contacts the fixed contact sections 37, 39, thereby limiting the travel of the pivot section by a limited distance beyond the alignment line 57 when the movable contact 15 is in the open position. In addition, the knife edge 49 is located directly below the contact surfaces of the contact 55 to minimize contact wipe and resulting contact wear.

When the movable contact 15 moves from the closed to the open position (FIG. 3), an arc 39 occurs between the separated contacts and is restricted to the contacts 15, 55 with a resulting path of current travel being through the contact 55, the pivot section 41, the knife edge 49, and the mounting bracket 25. Thus, the arc 61 avoids the contacts 13 which remain clean and run cooler than the pivot section 41. Small sheets 63 of insulating material are mounted between the fixed contact sections 37, 39 and the pivot section 41 to space the contact sections apart to prevent the pivot section from being welded to the fixed section when an arc 39 occurs. The sheets 63 also retain the contact spring 53 behind the pivot section 41. In order to maximize the electric conductivity between the pivot section 41 and the upturned portion 47, the knife edge 49 and the groove 51 are provided with surfaces coated with silver inlay or shim which are brazed in place in order to minimize the heating effect of the contacting parts when current flows.

The advantages of the pivot section 41 disposed between the two fixed sections 37, 39 is the provision of one additional contact point to increase the continuous current carrying capacity of the contactor, momentary contact before and after the fixed contact section when the contactor is closed and opened, and the provision of vibration resistance by the pivot section.

The movable contact 15 (FIG. 1) is free to move tortionally so that it may twist as necessary to make contact with both fixed contact sections 37, 39. The moving contact mounting bracket 27 and the shunt connector 29 are bolted by bolts 67 to the upper end of the lever 65 which is a T-shaped member. Projecting ends of shunt connector 29 are bolted to the shunts 31 by bolts 68 (FIG. 3). The lower end of the lever is pivoted about an upturned portion of a mounting bracket 69. Vertical and horizontal movement of the lever 65 is limited at its pivot point by a roll pin 71 which is secured in the bracket 69. The pin 71 extends through an aperture 73 which is larger than the diameter of the pin to enable limited vertical and horizontal movement. The lower end portion of the lever projects into a slot 75 in the bracket 69 to prevent disengagement of the lever from the pin 71.

A washer 77 on the pin 71 is located between the upturned portion of the bracket 69 and the lever 65 to provide for free tortional movement of lever.

Figure 2:
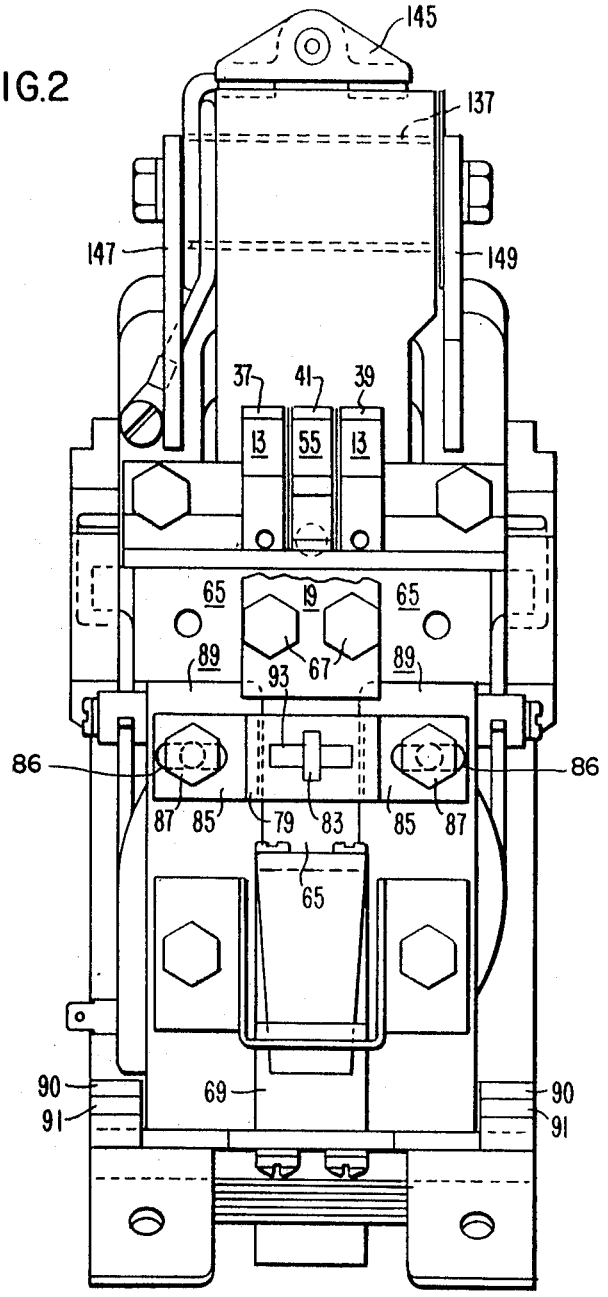
FIG. 2 is a front view of the contactor with the arc chute removed.

The lever 65 is additionally guided by a spring support structure comprising a U-shaped bracket 79, a coil spring 81, and a link 83. The bracket 79 is provided with out-turned flanges 85 which are secured by similar bolts 87 (FIG. 2) to an armature 89 of the electromagnet 5. Each flange 85 includes an elongated hole or slot 86 to permit lateral adjustment of the position of the movable contact 15 and to provide means of aligning the vertical edges of the contact free of the movable contact with the outer edges of the stationary contacts 13. The link 83 extends through the bracket 79 with the ring end portion retained against the outer end of the bracket by a pin 93 and with the left end portion secured by a pin 95 in a notch 97 in the lever 65. The coil spring 81, being disposed around the link 83 is compressed between the outer end of the bracket 79 and a washer 99 against the lever 65. When the armature 89 is in the open gap position (FIG. 3), the contacts 13, 15 are open and the lever 65 is urged towards the armature by the spring 81. The armature 89 and the lever 65 are pivoted at different locations so that when the armature opens and closes there is a linear displacement between the armature and the lever at the point where the armature and lever would engage were it not for link and pins 83, 93, 95.

When the armature is in the closed position (FIG. 1), the spring 81 is compressed against the lever 65 to retain the contacts 13, 15 in tightly closed positions despite normal contact wear and manufacturing tolerances. Inasmuch as the armature 89 and the lever 65 are pivoted at different locations, there is considerable linear displacement between the armature and the lever at the location of the link 83.

If the lever 65 were to strike the armature 89 when the contacts 13, 15 separate, sliding friction would result between the lever and armature. To avoid such friction the travel of the lever 65 is limited by the link 83 in which the pins 93, 95, being roll pins, are pressed in place at opposite ends and serve as low friction pivot points. Since the link 83 is free to pivot at both ends, the armature 89 and the lever 65 are able to rotate freely about different pivot points.

When the contacts 13, 15 are closed, the lever 65 stops moving, but the armature 89 continues moving until it reaches the closed position and the movable contact 15 is held in engagement with the stationary contact by the lever 65. The movable contact 15 being a single piece member spans all three stationary contact sections 13, 55. With new contacts, a predetermined overtravel gap is provided at one or both ends of the link 83 so that proper contact force is maintained despite variations in component parts due to manufacturing tolerances and/or normal wear. The shunts 31, being made of fine braded wire, are flexible members which, together with the pin 71 in the oversized aperture 73, permit free tortional movement of the moving contact assembly.

The operating electromagnet 5 consists of the armature 89, a U-shaped magnetic frame 101, a round magnetic core 103, an operating coil 105, and a magnetic pole face 107. The lower end of the armature 89 is beveled or has a knife edge bearing surface 109 pivotally mounted on the base plate 3, where it serves as the pivot point for the armature. The armature 89 is positioned laterally by upturned ears 90 on the base plate 3 and vertically by pins 91 (FIG. 3) extending below the ears from opposite sides of the armature.

The mounting bracket 69 is bolted to the base plate 3. The upper end of the bracket supports the upper end of a kick-out spring 111, the lower end of which biases an arm 113 downwardly. As shown in FIG. 1, the arm 113 is bolted at 115 to the armature 89 so that when the electromagnet 5 is deenergized the spring 111 moves the armature 89 clockwise to open the contacts 13, 15. The outer end of the arm 113 may be used to operate electrical interlocks (not shown) associated with the contactor 1, or provide mechanical interlocking between the arc chute 11 and the contacts 13, 15.

Moreover, a leaf spring 112 (FIG. 1) is mounted on the bracket 69 by a bolt 114 to make connection with a flange 116 of a load arc horn connector 118 and to provide a complete electrical path to the base plate 3. When the arc chute 11 is removed for any purpose, such as maintenance, the spring 112 moves to the broken line position 112*a* where its lower end extends into the path of upward movement of an ear 113*a* of the arm 113 when the arm is in broken line position 113*b*. Thus, the contactor cannot be operated until the arc chute is replaced.

In some circumstances an overcurrent latch is necessary to prevent the contacts 13, 15 from opening in the event load current exceeds a predetermined value even through the electromagnet is deenergized. When the load current later decays to a second predetermined value, the latch will disengage to allow the contacts 13, 15 to open if the electromagnet 5 is also deenergized. A typical magnetic contactor generally used in industry may from time to time see load currents 4 to 10 times the rating of the contactor. If this overload condition persists, an overload relay will act to open the contactor in which case the contactor must interrupt whatever load current is flowing to remove the load from the power system. In these applications the power system capacity is practically unlimited. In some special applications, it is not necessary that the contactor be opened under overload conditions. Thus, the contactor interrupting rating may be the same as its continuous rating. However, under overload conditions it is important that the contacts remain closed even though the operating magnet 5 is deenergized.

The latch structure consists of a latch lever 117 and a latch magnet 119. A latch rollr 121 is provided on at least one side of the armature 89, depending upon whether one or a pair of latch levers are also provided. The latch lever 117 is pivoted on the housing 7 at 123 and includes a hook or upturned portion 125 for engaging the latch roller 121 when the latch magnet 119 is energized. When the latch magnet 119 is deenergized, a coil spring 127 positions the lever 117 at a broken line position 117*a* and likewise positions the hook 125 to an unlatched position with the roller 121. The lever 117 includes a down-turned portion 129 having an armature 131 at the lower end thereof.

Figure 5:
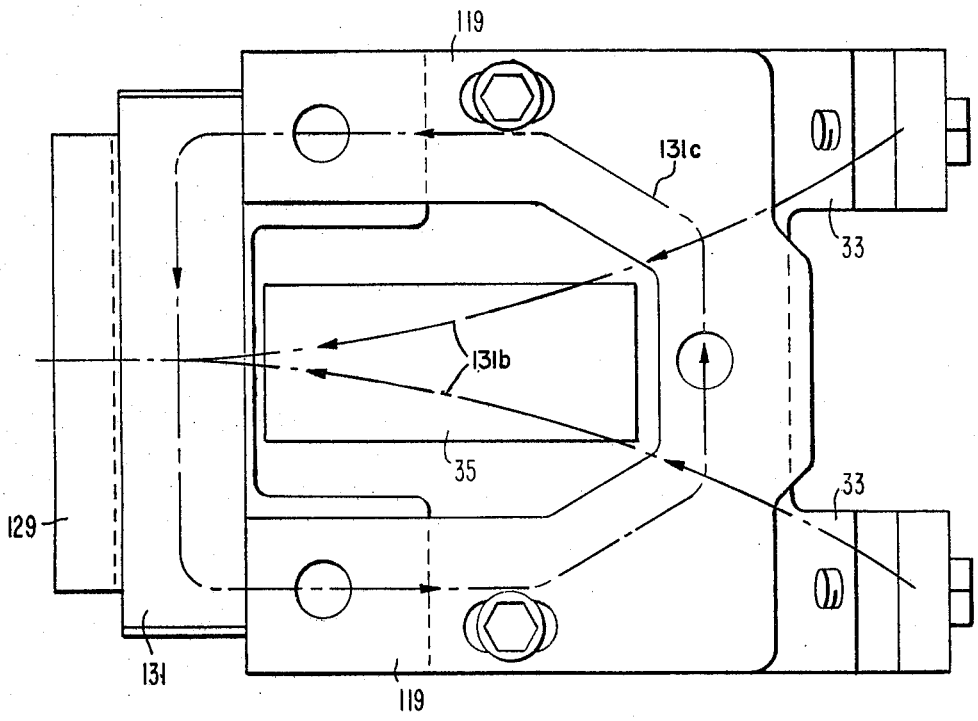
FIG. 5 is a horizontal view taken on the line V—V of FIG. 1.

The latch magnet 119 (FIG. 5) is a U-shaped magnetic yoke disposed around the load terminal 35. Under normal operating conditions, a large air gap 132 (FIG. 1) exists between the armature 131*a* and the pole face of the latch magnet 119 and the hook 125 is disengaged from the roller 121. When a load current 131*b* (FIG. 5) flows through the shunt connector 33 and the load terminal 35, it acts to magnetize the latch magnet 119 and the armature 131. When the load current 131*b* and the magnetizing force 131*c* reach a predetermined value, determined by restraining force of the oil spring 127, the latch armature 131 is attracted to the latch magnet 119 to move the latch lever 117 into the engaged position with the hooks 125 in front of the latch rollers 121.

As set forth above, the contactor 1 of this invention is a single pole magnet closed device employing an electromagnetic blowout type contact structure together with a single break main contact. The arc blowout unit 9 comprises a magnetic blowout coil 133 (FIG. 3) and a ferromagnetic core 135. The coil 133, being mounted on the insulating base 7, consists of a single turn around the core 135 and is an extension of line terminal 21. Inasmuch as the electric circuit moves from the line terminals and through the blowout coil 133, the blowout coil is on continuous duty. Space is not available, however, for a multiple turn continuous duty coil.

For that reason, in accordance with this invention, an auxiliary coil 137 is provided which operates intermittently, that is, when the arc 39 transfers to a line arc horn 140 after contacts 13, 15 are separated.

The auxiliary coil 137 comprises end portions 137*a* and 137*b* (FIG. 1), the former of which is secured by suitable means, such as a screw 139, to the lower end of the blowout coil 133 adjacent to the stationary contact 13. The end portion 137*b* is connected to a line arc horn assembly 141 through a conductor 143 extending through an insulator mounting 145. The auxiliary coil 137 has a plurality of, such as four, coil turns around the core 135. A pair of pole pieces 147, 149 extend from the ends of the core 135. The pole pieces 147, 149 are ferromagnetic flux carrying members, one pole piece extending from one end of the core 135 and the other pole piece extending from the other end of the core and radially of the coils 133, 137 to opposite sides of the arc chute 11. Thus, when load current flows a magnetic field is generated between the pole pieces so that when an arc occurs under load conditions, the arc is more readily transferred from the contacts 13, 15 to the line arc horn 140 and a load arc horn 151.

Under heavy load conditions the single turn blowout coil 133 provides sufficient magnetizing forces to saturate the ferromagnetic core 135 so that maximum blowout field strength is available when the main contacts 13, 15 separate, whereby optimum blowout field conditions prevail for arc interruption in the arc chute 11. When the arc 39 transfers to the line arc horn 140, the auxiliary coil 137, which is connected in series with the coil 133, increases the blowout magnetizing force. Under heavy load conditions the core 135 is saturated and the additional magnetizing force developed by the auxiliary coil 137 is unnecessary. However, where lighter loads exist, the single turn coil 133 is unable to develop sufficient magnetizing force to provide an adequate blowout field strength to interrupt the arc 39. Under this condition the extra magnetizing force provided by the multiple turn auxiliary coil 137 is necessary.

Accordingly, the device of this invention provides a compact, low cost, single pole, DC magnetic conductor having increased ratings for a given size and comprising unique contact structure, contact support construction, and magnetic blowout coil arrangement.

What is claimed is:

1. A contactor comprising stationary contact means including a plurality of stationary contact sections including fixed contact sections and a pivot contact section and mounted on a first conductor, a movable contact mounted on a movable conductor which is movable between open and closed contact positions, the fixed contact sections having substantially aligned contact surfaces facing the movable contact, the first conductor having a pivot edge on which the pivot section is mounted, the pivot edge being aligned with the contacting surfaces, spring means between the pivot edge and the contact surfaces for holding the pivot section against the pivot edge and for biasing the contact surface of the pivot section out of alignment with those of the stationary contact sections on the side of the movable contact, and electromagnetic means for moving the movable conductor to the closed position and operative means for moving the movable conductor to the open position when the electromagnetic means is deenergized.

2. The contactor of claim 1 in which the pivot section comprises groove means in which the pivot edge is seated.

3. The contactor of claim 2 in which the groove means is on the side of the pivot section facing the movable contact, and the spring means comprises a coil spring urging the pivot section toward the movable contact.

4. The contact of claim 3 in which the pivot section is located between a pair of stationary contact sections.

5. The contactor of claim 4 in which the stationary contact means comprises stop means for limiting the pivotal movement of the pivot section in response to the coil spring.

6. The contactor of claim 1 in which the movable conductor is pivotally mounted, the electromagnetic means including an armature, and means operatively connecting the armature to the moving conductor for closing the contacts when the electromagnetic means is actuated.

7. The contactor of claim 5 in which the connecting means comprises a movable contact spring for pressing the closed contacts together.

8. The contactor of claim 6 in which a kickout spring is operatively connected to the armature to facilitate opening of the contacts when the electromagnet is deenergized.

9. The contactor of claim 1 in which the movable conductor comprises a support lever that is pivotally mounted to permit in an out, lateral, and torsional movement of the moving contact.

10. The contactor of claim 1 in which the guide means for the upper end of the moving contact support is mounted by means of horizontally elongated holes to provide for lateral adjustment to effect alignment of the vertical edges of the movable contact with the outer edges of the stationary contact faces.

11. The contactor of claim 1 comprising a terminal, conductor means between the terminal and the first conductor, and the first conductor being detachably mounted on the conductor means.

12. The contactor of claim 1 in which a detachably mounted support for the stationary contacts is removable from the front of the contactor to permit removal of the stationary contacts without disturbing permanent contactor details or connections.

13. A contactor comprising stationary and movable contacts operable between open and closed positions, mounting means for the movable contact comprising a lever, pivot means mounting the lever to effect limited vertical and horizontal movement of the movable contacts with respect to the stationary contacts, electromagnetic means including an armature for moving the lever, link means between the lever and the armature and comprising a suspension rod and spring structure for effecting limited moving frictionless contact travel and kickout spring means connected to the assembly of the armature and lever for facilitating separation of the contacts when the electromagnetic means is deenergized.

14. The contactor of claim 13 in which the pivot means comprises a pivot pin loosely mounting the lever and extending on an axis substantially parallel to the direction of contact movement.

15. A contactor comprising stationary and movable contacts operable between open and closed positions, mounting means for the movable contact, a conductor mounting the stationary contact, an arc chute adjacent to the contacts, are blowout means for withdrawing an arc from between the contacts and comprising a first looped portion of the conductor and a ferromagnetic core in the looped portion, said blowout means also comprising a second looped conductor around the magnetic core and connected in series with the first looped portion only during arc interruption to effect an increase in the blowout magnetizing force, and said second looped conductor being effective with said first looped portion to develop additional magnetizing force in the coil when lighter overloads exist.

16. The contactor of claim 14 in which the arc blowout means also comprises a pair of ferromagnetic pole piece plates, and each plate secured to the end of the magnetic core and extending to opposite sides of the arc chute to generate an increased magnetic field therebetween and within the arc chute.

17. The contactor of claim 16 in which the arc chute comprises a line arc horn and a load arc horn extending from spaced locations near the contacts to divergent locations, the contactor comprising a load terminal, and the load arc horn being connected to the load terminal.

18. The contactor of claim 16 in which the load arc horn includes a lateral-extending member, an anti-close leaf spring biased by said member in a closed position when the arc chute is mounted on the contactor, and an interlock arm on the armature extending across the end of the leaf spring when the armature is open to prevent closure of the armature when the arc chute is removed.

* * * * *